United States Patent [19]

Lai

[11] Patent Number: 5,020,559

[45] Date of Patent: Jun. 4, 1991

[54] UMBRELLA COVER CONSTRUCTION

[76] Inventor: Chenmin Lai, 2, Alley 2, Lane 102, Dong Hwa St., Taipei, Taiwan

[21] Appl. No.: 275,065

[22] Filed: Nov. 22, 1988

[51] Int. Cl.[5] ..... A45B 25/18

[52] U.S. Cl. ..... 135/33.2; 135/15.1

[58] Field of Search ..... 135/33 R, 34, 20 R, 135/20 A

[56] References Cited

U.S. PATENT DOCUMENTS

| | | | |
|---|---|---|---|
| 635,811 | 10/1899 | Rothschild | 135/34 |
| 2,496,501 | 2/1950 | Staunton et al. | 135/20 R |
| 3,429,320 | 2/1969 | Edelkind | 135/34 |
| 3,557,809 | 1/1971 | Vazquez et al. | 135/33 R |
| 3,844,301 | 10/1974 | Harrell | 135/34 X |
| 4,624,275 | 11/1986 | Baldwin | 135/33 R |
| 4,794,939 | 1/1989 | Okuda | 135/33 R |

FOREIGN PATENT DOCUMENTS

| | | | |
|---|---|---|---|
| 224526 | 11/1942 | Switzerland | 135/34 |

*Primary Examiner*—David A. Scherbel
*Assistant Examiner*—Lan Mai
*Attorney, Agent, or Firm*—Morton J. Rosenberg; David I. Klein

[57] ABSTRACT

The construction of an umbrella cover is provided wherein the periphery of the umbrella cover cloth is arranged to provide straight meshes. The umbrella cover construction can accommodate umbrella ribs which are arranged in either equal or unequal intervals therebetween. The construction of the cover cloth is arranged with the radially extending umbrella ribs disposed on the bias of the cloth and coupled to peripheral portions thereof, having straight edges extending therefrom which are substantially either parallel or orthogonal to the warp or weft of the cloth. Thus, the umbrella cover can be formed of a single piece of material, upon which a decorative pattern can easily be printed thereon, while still allowing the umbrella cover to be stretched, when the umbrella is opened, to form a curved surface.

3 Claims, 5 Drawing Sheets

PRIOR ART

PRIOR ART

UMBRELLA COVER CONSTRUCTION

BACKGROUND OF THE INVENTION

The present invention is related to the construction of an umbrella cover. More particularly, the present invention is directed to the construction of an umbrella cover which utilizes a single piece of cloth wherein the peripheral edges extend either parallel or orthogonal to the warp and the weft of the cover material. Further, this invention is directed to the construction of an umbrella cover wherein the umbrella ribs are coupled to the umbrella cover so as to form a twilled structure to allow stretching of the material along the bias, the radial lines extending from the center of the cover, defined by the umbrella ribs.

In some prior art systems, such as that shown in FIGS. 1A–1C, umbrella covers are formed by a plurality of gores 80, as shown in FIG. 1B. In such prior art covers the number of gores 80 utilized typically corresponds to the number of umbrella ribs to be coupled thereto. As shown in FIG. 1A, the gores 80 are sewn together by a plurality of stitched seams 81, the number of seams being equal to the number of umbrella ribs. Therefore, any decorative pattern printed on the umbrella cover cannot be formed on a single cover cloth prior to the assembly of the plurality of gores 80.

Prior art methods for manufacturing umbrella covers typically require the material to have received its decorative printing prior to the tailoring operations. However, in the trimming operations wherein the gores 80 are cut from a single piece of material, some waste portions 82 will inevitably exist, as shown in FIG. 1C. Thus, some of the printed pattern will be removed, making it unlikely that the pattern disposed on each of the gores can be matched when the gores are sewn together to form the umbrella cover. Further, the arcuate radially extending stitched seams 81 coupling the gores together will also interfere with attempts to match the pattern. Further, well matched patterns are more difficult to obtain in mass production type operations since the processes for trimming the gores and sewing the arcuate seams are not easily controlled.

In view of this matching problem in the manufacture of prior art umbrella covers, decorative patterns must be applied to each individual gore 80 and then subsequently sewn together to form an umbrella cover. However, the radially extending sewn seams still provide an interruption to the decorative pattern of the umbrella cover.

Other prior art systems have provided an improvement to the construction of umbrella covers by using the property of some materials like nylon, taffeta, etc. These materials do not stretch along the direction of the warp or the weft, but are able to stretch along an oblique direction, the bias. As shown in FIGS. 2A, 2B and 2C, the gores are trimmed along the warp and the weft and sewn together to form an umbrella cover cloth wherein the peripheral straight edges are either parallel or orthogonal to the warp and the weft of the cloth. The construction providing twilled seams provided at the radial stitching, thereby letting the umbrella cover provide a curved surface when it is stretched by the umbrella ribs, when the umbrella is opened.

It is an object of the present invention to provide an umbrella cover formed from a single piece of cloth.

It is another object of the present invention to provide an umbrella cover formed from a single piece of cloth to which matching supplementary cloths are coupled to peripheral portions thereof.

It is yet another object of the present invention to provide an umbrella cover which is easily manufactured and upon which a decorative pattern can be printed thereon.

These and other advantages and novel features of the invention will become apparent from the following detailed description when considered in conjunction with the accompanying drawings wherein:

DESCRIPTION OF THE PREFERRED EMBODIMENTS

Figure 1A:
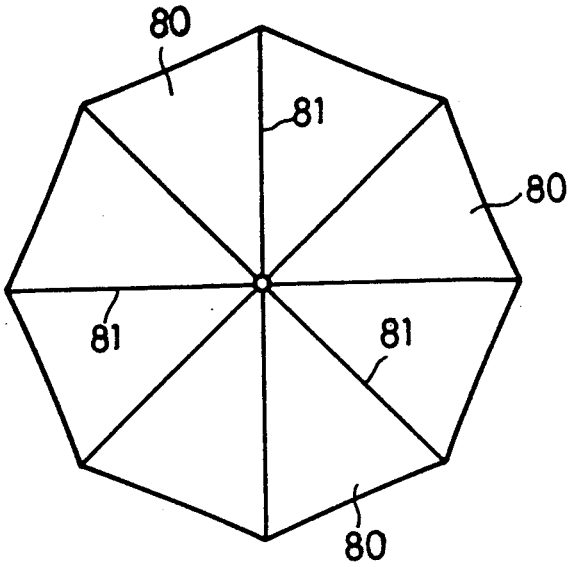
FIG. 1A is a plan view of a prior art umbrella cover.
Figure 1B:
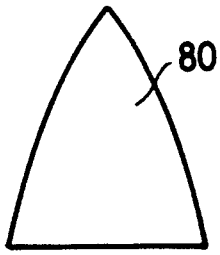
PRIOR ART FIG.1B
FIG. 1B is a plan view of an individual gore of a prior art umbrella cover.
Figure 1C:
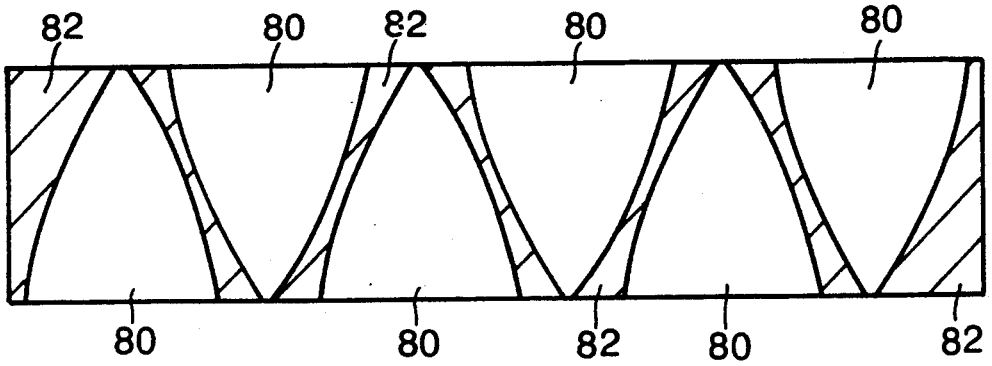
PRIOR ART FIG.1C
FIG. 1C is a schematic drawing indicating a prior art pattern for removing gores from a sheet of material.
Figure 2A:
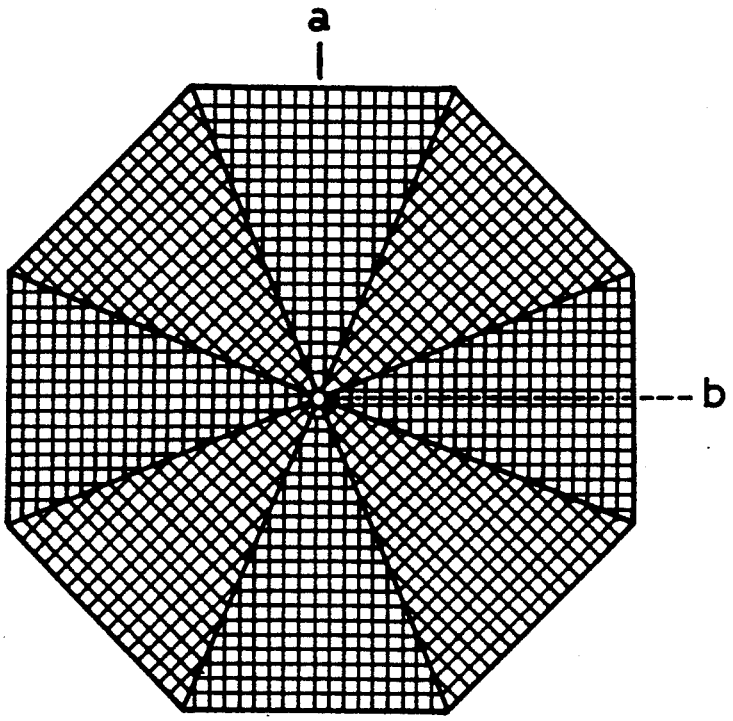
FIG. 2A is a plan view of an alternate prior art umbrella cover.
Figure 2B:
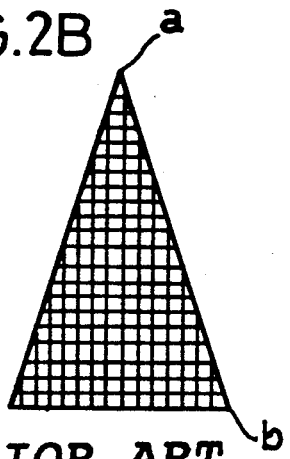
PRIOR ART FIG. 2B
FIG. 2B is a plan view of an individual gore of an alternate prior art umbrella cover.
Figure 2C:
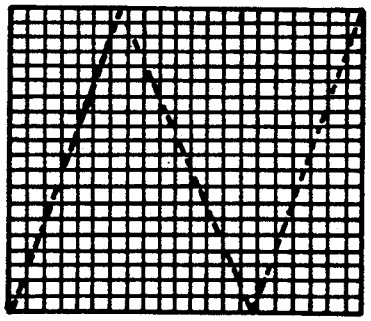
PRIOR ART FIG. 2C
FIG. 2C is a schematic drawing indicating an alternate prior art pattern for removing gores from a sheet of material.
Figure 3A:
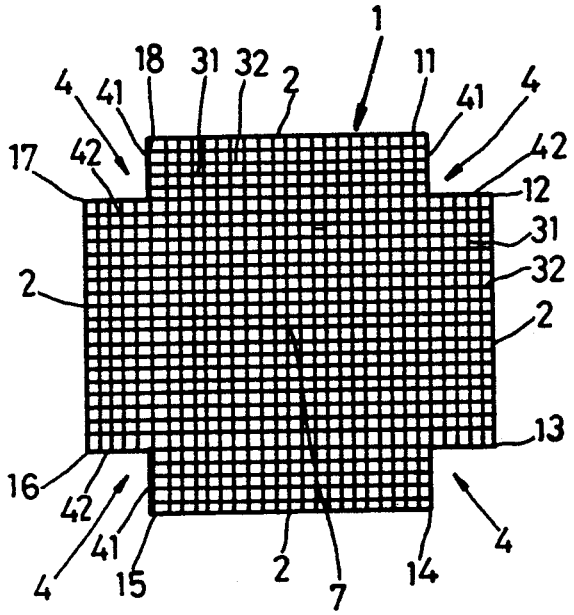
FIG. 3A is a plan view of an umbrella cover according to a first embodiment of the present invention.
Figure 3C:
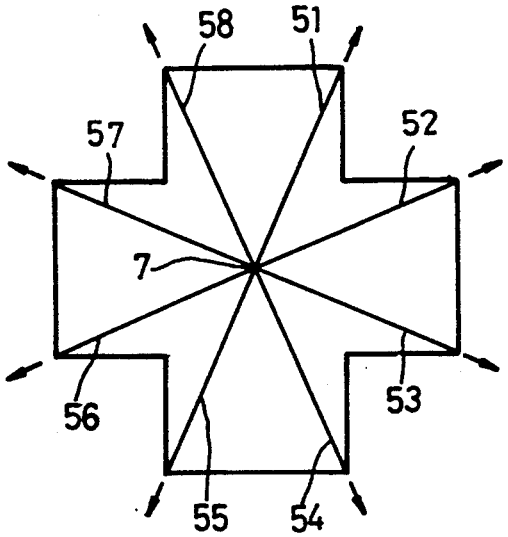
FIG. 3C is a schematic drawing showing the umbrella rib pattern with respect to the umbrella cover embodiment of FIG. 3B.

Referring to the first preferred embodiment, as shown in FIG. 3A, an umbrella cover 1 of parallel warp and weft construction is provided for use with an umbrella rib pattern having ribs spaced at unequal intervals. This unequal interval can be observed by comparing the distance between the rib attachment points 11 and 12 with the attachment points 12 and 13, the distance therebetween being substantially different. However, the length of the ribs are all identical, the distance between the center 7 of umbrella cover 1 and any of the attachment points 11, 12, 13, 14, 15, 16, 17 and 18 being equal. The peripheral edges 2 are arranged to provide straight meshes, or edge seams which are disposed orthogonal or parallel to the warp 31 or weft 32, respectively. An important characteristic of the umbrella cover 1 is the cut-out portions 4 disposed at corner portions wherein two adjacent lateral sides 2 would come together. The cut-out portion 4 is defined by a pair of orthogonal sides 41 and 42, defining a right angle therebetween.

This structure wherein the umbrella ribs extend radially from the central point 7 to each of the peripheral corners 11–18 defines twilled lines with respect to the warp 31 and the weft 32, permitting the cover to stretch along the oblique lines defined by the ribs when the umbrella is opened.

A crevice or slit is provided at the central point 7 of the umbrella cover 1 for receiving the top end portion of an umbrella frame therein, thereby allowing the rear end of the umbrella ribs to each be respectively connected with the umbrella cover peripheral corner portions 11–18 of umbrella cover 1 and stitched thereto. When the umbrella ribs are expanded to the open position, the umbrella cover 1 is able to be stretched by virtue of the twill fabric construction wherein the stretching forces are applied obliquely by the radially extending umbrella ribs. Therefore, the umbrella cover 1 is able to form a curved surface with the lateral peripheral sides 2, 41 and 42 of umbrella cover 1 being arranged to provide straight edge seams. The umbrella cover 1 forms a tightly stretched curved surface, being stretched over the umbrella framework like a drum membrane on a drum. The stretched cover 1 is wrinkle-free and devoid of any stitching along the radial lines defined by the umbrella ribs. Thus, the umbrella cover 1 is adapted for receiving a full decorative pattern being printed thereon prior to assembly and will be displayed in its entirety when assembled to an umbrella structure.

Figure 3B:
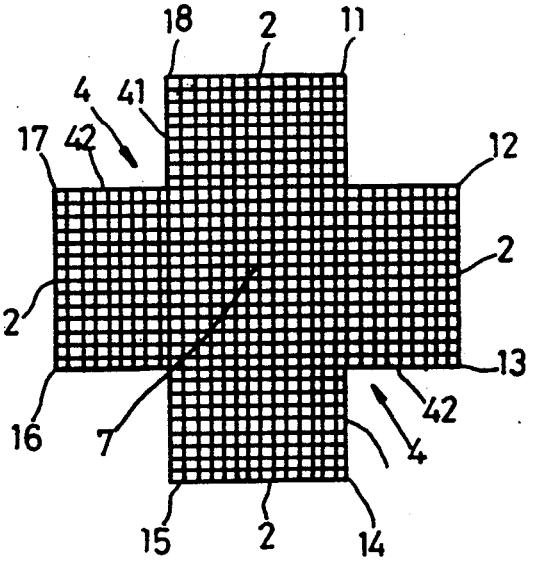
FIG. 3B is a plan view of an alternate configuration of an umbrella cover according to the first embodiment of the present invention.

Referring to FIG. 3B, there is shown an alternate configuration for the first preferred embodiment of FIG. 3A. The umbrella cover 1, of this alternate configuration, is adapted for use with umbrella structures having ribs spaced at equal intervals. The major lateral sides 2 and the lateral sides 41 and 42 of the cutout portions 4 are again arranged to provide straight edge seams, with the fabric construction being stretchable in oblique directions, as defined by the radial directions defined between the central point 7 and each of the peripheral corner portions 11–18. Hence, when the umbrella is opened and the umbrella ribs are extended, the umbrella cover 1 is stretched radially to provide a curved surface upon which an entire decorative pattern, having been printed thereon, can be viewed.

Figure 3D:
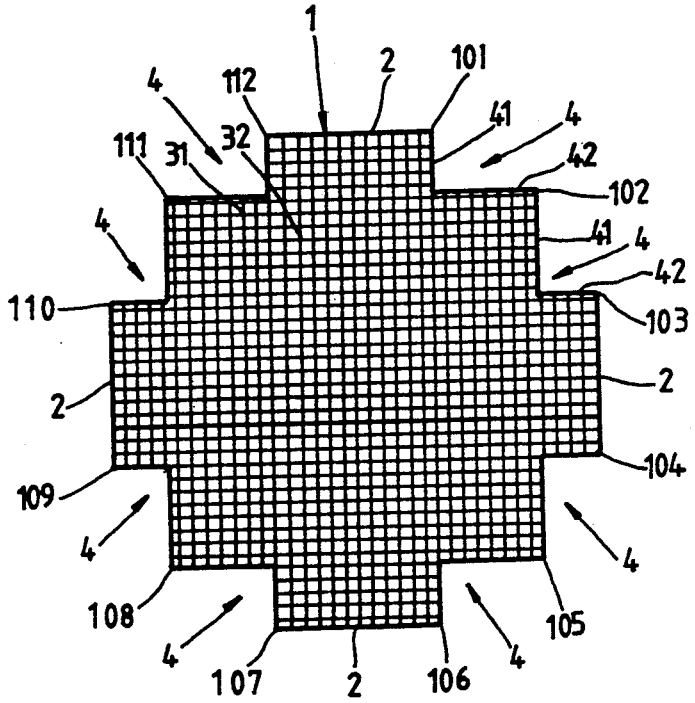
FIG. 3D is a plan view of a second alternate configuration for the first embodiment of the present invention.
Figure 3E:
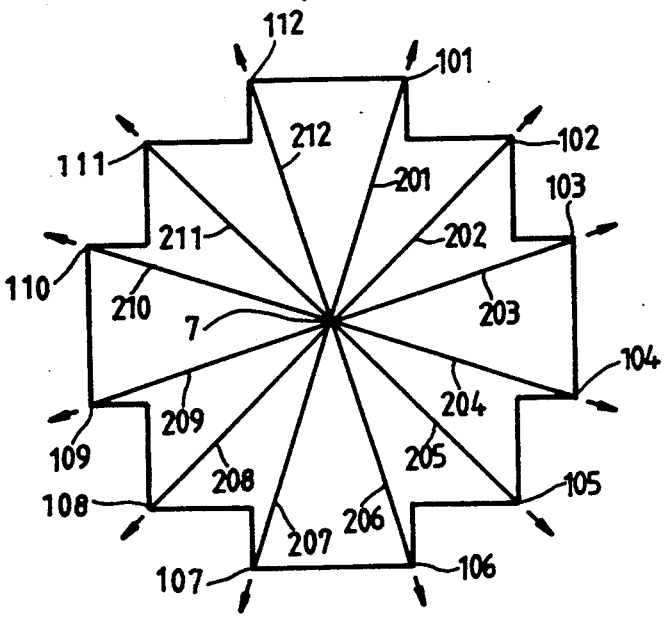
FIG. 3E is a schematic drawing showing the umbrella rib pattern with respect to the umbrella cover of FIG. 3D.
Figure 3F:
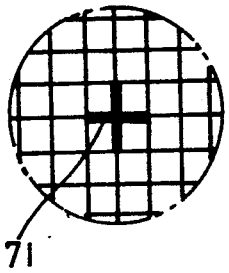
FIG. 3F is an enlarged plan view of a central portion of the umbrella cover of FIG. 3D.

Referring now to FIGS. 3D–3F, there is shown another alternate configuration for the first preferred embodiment of the present invention. The umbrella cover 1 is adapted to be utilized with an umbrella structure having twelve radially directed ribs 201–212, which may be spaced at equal or unequal intervals. Here again, the major lateral sides 2 of the umbrella cover 1 are arranged to provide straight edge seams. However, this configuration differs from that previously described in that there are a plurality of cut-out portions 4 formed between two adjacent lateral sides 2. Each of the cut-out portions 4 are defined by the orthogonal lateral sides 41 and 42, which also provide straight edge seams for the periphery of the cover 1. As shown in FIG. 3E, the umbrella ribs 201–212 extend from the central point 7 of the umbrella cover radially to respective corner portions 101–112, defined by the junctions between respective lateral sides 2, 41 and 42 of umbrella cover 1. The umbrella ribs 31 201–212 each extend radially with respect to the warp and weft 32 of the fabric to form a twilled construction, wherein the fabric stretches in the radial direction defined by the ribs.

The umbrella cover 1 is also provided with a slit 71, shown in FIG. 3F, disposed at the central portion of the cover for receiving the top end portion of the umbrella frame structure therein. As previously described, the slit 71 allows the rear end of the umbrella ribs to be joined by sewing to respective peripheral corner portions 101–112. This arrangement takes advantage of the natural and outward stretch property of the cover material, the umbrella cover 1 thereby forming a natural curved surface, when the umbrella is opened, with the lateral sides 2, 41 and 42 arranged in straight edge seams.

As shown in FIG. 3F, the slit 71 formed at the central point 7 of umbrella cover 1 may be a single slit-like opening 71 or alternately a cross-like slit 71 through which the top end portion of the umbrella frame may be inserted. The formation of a slit in the central portion of the umbrella cover is far less complicated to manufacture than forming a circular central through opening surrounded by stitching, as found in prior art umbrella covers.

Figure 4A:
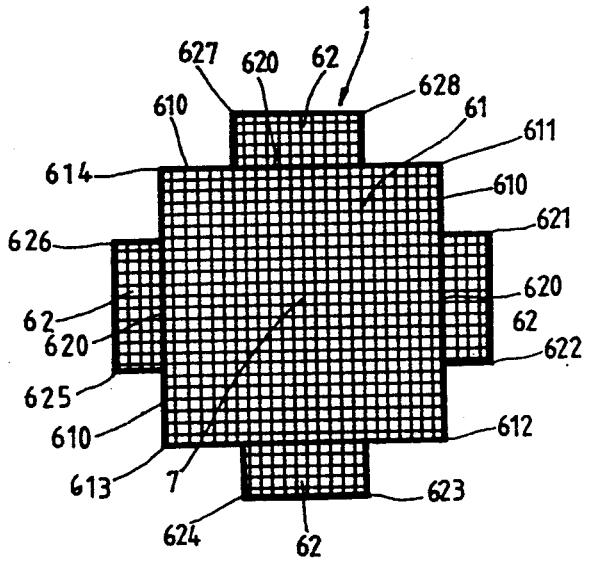
FIG. 4A is a plan view of an umbrella cover according to a second embodiment of the present invention.

Referring to FIG. 4A, there is shown a second preferred embodiment of the umbrella cover 1 for use with an umbrella structure having twelve ribs. In this embodiment, the umbrella cover 1 comprises a main cover cloth 61 to which four supplementary cover cloths 62 are sewn. The lateral sides 620 of each of the four supplementary cover cloths is sewn to a respective lateral side 610 of the main cover cloth 61. Each of the four supplementary cover cloths 62 are arranged to have their warp and weft match the warp and weft of the main cover cloth 61 such that the twilled structure results along the radial lines between the central point 7 and each of the resulting peripheral corner portions 611, 621, 622, 612, 623, 624, 613, 625, 626, 614, 627 and 628, thereby allowing the cover to form a curved surface when the umbrella is opened and the expanding ribs stretch the umbrella cover 1.

Figure 4D:
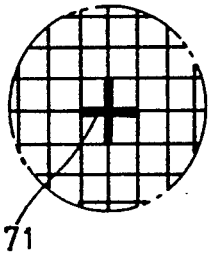
FIG. 4B is a plan view of an alternate configuration for the umbrella cover according to the second embodiment of the present invention.
FIG. 4C is a schematic drawing illustrating the relationship of the umbrella ribs with respect to the umbrella cover for the embodiment shown in FIG. 4B; and, FIG. 4D is an enlarged plan view of the central portion of the second embodiment of the umbrella cover as shown in FIG. 4A and FIG. 4B.
Figure 4C:
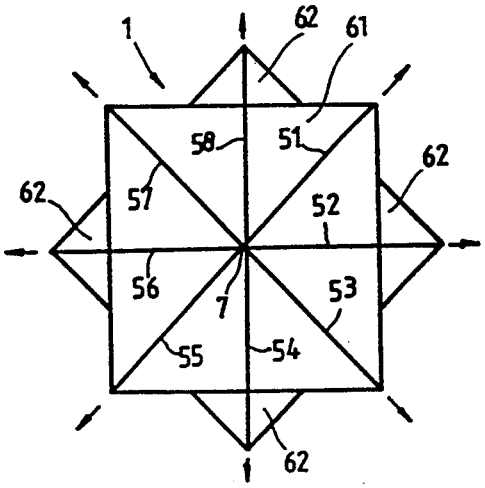
Figure 4B:
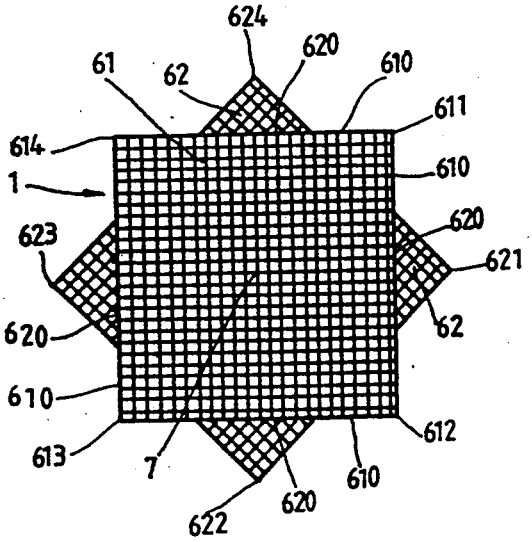

In an alternate configuration for the second preferred embodiment, as shown in FIGS. 4B and 4C, the umbrella cover 1 is used with an umbrella structure having eight ribs. In this configuration, the umbrella cover is comprised of a main cover cloth 61 to which are sewn four triangularly shaped supplementary cover cloths 62. The lateral sides 620 of each of the four triangular supplementary cover cloths 62 are sewn to respective lateral sides 610 of the main cover cloth 61. The warp and weft of the triangular supplementary cover cloths 62 does not match that of the main cover cloth 61, but is arranged such that the respective umbrella ribs 52, 54, 56, and 58 apply the stretching forces on the bias of the supplementary cover cloths 62, each being respectively coupled to the peripheral corner portions 621, 622, 623 and 624. The remaining four umbrella ribs 51, 53, 55, and 57 are each respectively coupled to the corner portions 611, 612, 613, 614 of the main cover cloth 61, the ribs extending radially from the center point 7 to each of the respective peripheral corner portions. Thereby applying the stretching forces on the bias of the main cover cloth 61. Thus, here again, the umbrella cover 1 forms a smooth curved surface when the umbrella is opened and the ribs stretch the cover.

As shown in FIG. 4D, the central point 7 for either configuration of the second preferred embodiment, as shown in FIGS. 4A and 4B, is provided with a slit 71. The slit 71 may be a singular slit or a cross-like slit, as previously described. The slit 71 provides the means by which the top end of the umbrella frame may be inserted through the umbrella cover 1.

The umbrella cover structure, as has been described, eliminates the requirement for sewing together a plurality of gores, and the need to tie the umbrella ribs to the seams therebetween. Such results in a simplification of the manufacturing process for the umbrella cover 1. Further, since the umbrella cover is arranged in one singular piece of material, such can receive decorative printing which when formed in the curved surface of the opened umbrella would be unobstructed by seams or unmatched adjacent edges. These advantages are obtainable irrespective of whether the umbrella covers 1 are produced in small quantity or mass production.

It will be understood by those skilled in the art that numerous modifications and improvements may be made to the preferred embodiments of the invention disclosed herein without departing from the spirit and scope thereof. In addition to the above-described embodiments for application on umbrella structures having eight or twelve ribs, the present invention is also applicable to umbrella structures having four, sixteen, twenty or twenty-four ribs.

I claim:

1. An umbrella cover for use with an umbrella structure having a plurality of umbrella ribs, comprising:

a normally planar cover cloth coupled to said umbrella structure having a warp extending in a first direction and a weft extending in a second direction, said second direction being orthogonal to said first direction, said cover cloth having a closed stepped outer contour defining a plurality of perimeter edges disposed in parallel relationship with either said warp or said weft, and said perimeter edges defining a plurality of vertices for respective coupling to end portions of said plurality of umbrella ribs.

2. The umbrella cover as recited in claim 1 where said normally planar cover cloth is formed in one-piece formation.

3. The umbrella cover as recited in claim 1 further comprising a plurality of supplementary cover cloth members, each of said plurality of supplementary cover cloth members being coupled to a respective one of said plurality of peripheral edges of said planar cover cloth, each of said plurality of supplementary cover cloth members defining at least one vertex for coupling with one of said plurality of umbrella ribs.

* * * * *